US011037514B2

(12) United States Patent
Du

(10) Patent No.: US 11,037,514 B2
(45) Date of Patent: Jun. 15, 2021

(54) GOA CIRCUIT FOR DISPLAY PANEL

(71) Applicant: Shenzhen China Star Optoelectronics Technology Co., Ltd., Shenzhen (CN)

(72) Inventor: Peng Du, Shenzhen (CN)

(73) Assignee: SHENZHEN CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 377 days.

(21) Appl. No.: 16/312,287

(22) PCT Filed: Sep. 26, 2018

(86) PCT No.: PCT/CN2018/107762
§ 371 (c)(1),
(2) Date: Dec. 21, 2018

(87) PCT Pub. No.: WO2020/024409
PCT Pub. Date: Feb. 6, 2020

(65) Prior Publication Data

US 2021/0118390 A1 Apr. 22, 2021

(30) Foreign Application Priority Data

Jul. 30, 2018 (CN) ..... 201810854564.X

(51) Int. Cl.
*G09G 3/36* (2006.01)

(52) U.S. Cl.
CPC ..... *G09G 3/3677* (2013.01)

(58) Field of Classification Search
CPC ..... G09G 3/3677
See application file for complete search history.

(56) References Cited

U.S. PATENT DOCUMENTS

2020/0357352 A1* 11/2020 Du ..... G09G 3/3677

FOREIGN PATENT DOCUMENTS

| | | | |
|---|---|---|---|
| CN | 103295516 | A | 9/2013 |
| CN | 104485079 | A | 4/2015 |
| CN | 104537991 | A | 4/2015 |
| CN | 105632564 | A | 6/2016 |
| CN | 106782386 | A | 5/2017 |
| CN | 107463041 | A | 12/2017 |
| CN | 107992229 | A | 5/2018 |

* cited by examiner

*Primary Examiner* — Deeprose Subedi
(74) *Attorney, Agent, or Firm* — Leong C. Lei

(57) ABSTRACT

The invention provides a GOA circuit for display panel. The GOA circuit comprises a plurality of cascaded GOA units, for n and m, a pull-up control circuit of n-th stage GOA unit comprising: a first TFT(T1) having gate connected to (n+m)-th stage scan signal, source and drain respectively connected to high voltage and gate signal node; a second TFT(T2), having floating gate and reserved welding pad for connecting start signal(STV), source and drain respectively connected to high voltage and gate signal node; a pull-down control circuit comprising: a third TFT(T4), having gate connected to (n−m)th stage scan signal, source and drain respectively connected to n-th stage scan signal and low voltage; a fourth TFT(T5), having gate connected to (n−m)th stage scan signal, source and drain connected to gate signal node and low voltage respectively. The invention realizes the cutting of display panel into strip screens of any aspect ratio.

10 Claims, 7 Drawing Sheets

GOA CIRCUIT FOR DISPLAY PANEL

BACKGROUND OF THE INVENTION

1. Field of the Invention

The present invention relates to the field of display techniques, and in particular to a gate driver on array (GOA) circuit for display panel.

2. The Related Arts

The thin film transistor liquid crystal display (TFT-LCD) panels are now more widely used in the public information display (PID) field. The aspect ratio of many PID panels is quite different from that of common TV panels, such as, a strip screen design.

To reduce cost, the strip screen and the conventional TV panel are sometimes made by using a common mask. The strip screen can be made only by changing the position of the cutting line. As shown in FIG. 1, FIG. 1 is a schematic view of making a strip screen by changing the position of the cutting line of the TV panel in the prior art. The aspect ratio of the TV panel 1 is 16:9. When cutting, it is only necessary to change the position of the cutting line opposite to the data driver IC bonding side to realize the production of PID strip screen of any aspect ratio.

This method is relatively easy to implement for a display panel wherein a gate line is driven by a driver IC. However, with the popularization of GOA technology, since the input of the start signal STV is required at both the first and last ends of the GOA circuit to turn on the GOA circuit stage-by-stage, and if cutting is performed in the middle of the display panel, it is possible, as a result, that the first stage of the GOA circuit will have no start signal STV input, and the entire GOA circuit does not work properly.

Existing GOA circuits typically comprise a plurality of cascaded GOA units, each level of GOA unit corresponding to driving a stage of horizontal scan line. The GOA unit generally comprises a pull-up circuit, a pull-up control circuit, a down-propagation circuit, a pull-down circuit, and a pull-down maintenance circuit, and a bootstrap capacitor responsible for the voltage level rise. The pull-up circuit is mainly responsible for outputting the clock signal as a gate signal (i.e., a scan signal); the pull-up control circuit is responsible for controlling the turn-on time of the pull-up circuit, and is generally connected to the down-propagation signal transmitted by the down-propagation circuit of the GOA unit of the previous stage, or the gate signal; the pull-down circuit is responsible for pulling the gate signal low to the low level at the first time, that is, turning off the gate signal; the pull-down maintenance circuit is responsible for maintaining the gate signal and the gate signal node of the pull-up circuit (generally called node Q) in the off state, usually there are two pull-down maintenance modules to operate alternately; the bootstrap capacitor is responsible for the second-time rise of the node Q, which is beneficial for the pull-up circuit to output the gate signal.

Nowadays, GOA technology is more and more widely used in display panels. In the display panel using GOA technology, the order of turning on the gate lines, that is, the scanning direction of the display panel is generally fixed. As shown in FIG. 2, FIG. 2 is a schematic view of a start signal connection of a GOA circuit for conventional display panel. The scanning direction of the display panel 3 is from bottom to top, wherein the ST signal is a start signal for turning the GOA circuit on stage-by-stage. In general, the start signal is connected to the first and last stages of the GOA circuit. When the display panel 3 in FIG. 2 is cut into a strip screen, the problem that the GOA circuit under the cut strip screen cannot connect to the ST signal is encountered, so that the entire GOA circuit cannot be normally turned on, and the strip screen cannot be driven normally.

SUMMARY OF THE INVENTION

The object of the present invention is to provide a GOA circuit for display panel, able to optimize the circuit structure design and realize cutting the display panel into strip screens of any aspect ratios.

To achieve the above object, the present invention provides a GOA circuit for display panel, which comprises: a plurality of cascaded GOA units, for natural numbers n and m, a pull-up control circuit of the n-th GOA unit responsible for outputting an n-th horizontal scan signal comprising:

a first thin film transistor (TFT) having a gate connected to a first scan direction signal, and a source and a drain respectively connected to an (n−m)th stage horizontal scan signal and a gate signal node of the n-th stage GOA unit;

a second TFT having a gate connected to a second scan direction signal, and a source and a drain respectively connected to an (n+m)th stage horizontal scan signal and the gate signal node of the n-th stage GOA unit;

a pull-down control circuit of the −nth stage GOA unit comprising:

a third TFT having a gate connected to the first scan direction signal, and a source and a drain respectively connected to the (n+m)th stage horizontal scan signal and a node;

a fourth TFT having a gate connected to the second scan direction signal, and a source and a drain respectively connected to the (n−m)th stage horizontal scan signal and the node;

a fifth TFT having a gate connected to the node, a source and a drain respectively connected to the n-th stage horizontal scan signal and a low voltage;

a sixth TFT having a gate connected to the node, and a source and a drain respectively connected to the gate signal node of the n-th stage GOA unit and the low voltage.

Wherein, the scan direction of the GOA circuit for display panel is set by changing relative voltage levels between the first scan direction signal and the second scan direction signal.

Wherein, the first scan direction signal is set to a high voltage, the second scan direction signal is set to a low voltage, and the GOA circuit for display panel realizes scanning from top to bottom.

Wherein, the first scan direction signal is set to a low voltage, the second scan direction signal is set to a high voltage, and the GOA circuit for display panel realizes scanning from bottom to top.

Wherein, the value of m is determined according to a number of clock signals required by the GOA circuit.

Wherein, for a GOA circuit requiring two clock signals, m is 1; for a GOA circuit requiring four clock signals, m is 2.

The present invention also provides a GOA circuit for display panel, which comprises: a plurality of cascaded GOA units, for natural numbers n and m, a pull-up control circuit of the n-th stage GOA unit responsible for outputting an n-th stage horizontal scan signal comprising:

a first thin film transistor (TFT) having a gate connected to an (n+m)th stage horizontal scan signal, and a source and a drain respectively connected to a high voltage and a gate signal node of the n-th stage GOA unit;

a second TFT having a gate in a floating state and reserved for welding pad for connecting a start signal, a source and a drain respectively connected to the high voltage and the gate signal node of the n-th stage GOA unit;

a pull-down control circuit of the n-th stage GOA unit comprising:

a third TFT having a gate connected to the (n−m)th stage horizontal scan signal, and a source and a drain respectively connected to the n-th stage horizontal scan signal and a low voltage;

a fourth TFT having a gate connected to the (n−m)th stage horizontal scan signal, and a source and a drain respectively connected to the gate signal node of the n-th stage GOA unit and the low voltage.

Wherein, when the display panel is cut into a strip screen, the gate of the second TFT of the last m-th stage GOA unit is connected to the start signal.

Wherein, the gate of the second TFT of the last m-th stage GOA unit is connected to the welding pad by laser welding.

Wherein, the value of m is determined according to a number of clock signals required by the GOA circuit; for a GOA circuit requiring two clock signals, m is 1; for a GOA circuit requiring four clock signals, m is 2.

Wherein, the n-th stage GOA unit further comprises a bootstrap capacitor and a pull-up circuit; the bootstrap capacitor has two ends respectively connected to the gate signal node of the n-th stage GOA unit and an n-th stage horizontal scan signal; the pull-up circuit comprises a fifth TFT; the fifth has a gate connected to the gate signal node of the n-th stage GOA unit, and a source and a drain respectively connected to the clock signal of the n-th stage GOA unit and the n-th stage horizontal scan signal.

In summary, the GOA circuit for display panel of the present invention optimize the circuit structure design and realize cutting the display panel into strip screens of any aspect ratios. The first embodiment of the present invention adopts a GOA circuit capable of changing the scanning order, so that the display panel can be cut into strip screens of any aspect ratio; the second embodiment of the present invention adds only one TFT to realize a narrower border design, and realizes that the display panel can be cut into strip screens of any aspect ratio.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technique means and effect of the present invention, the following uses preferred embodiments and drawings for detailed description.

Figure 1:
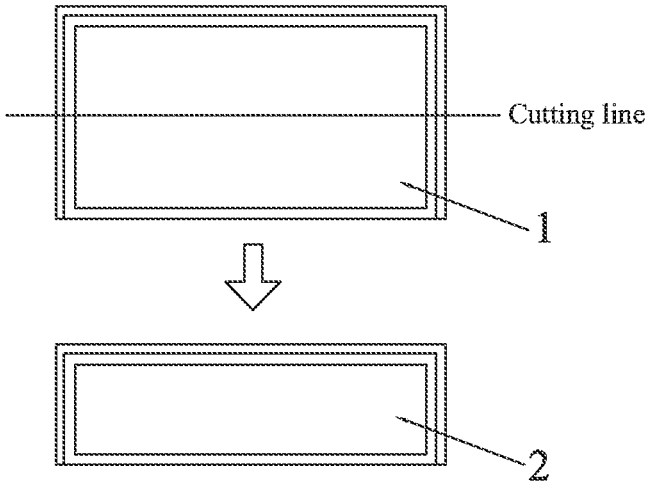
FIG. 1 is a schematic view showing the making of a strip screen by changing the position of the cutting line of the TV panel in the prior art.
Figure 2:
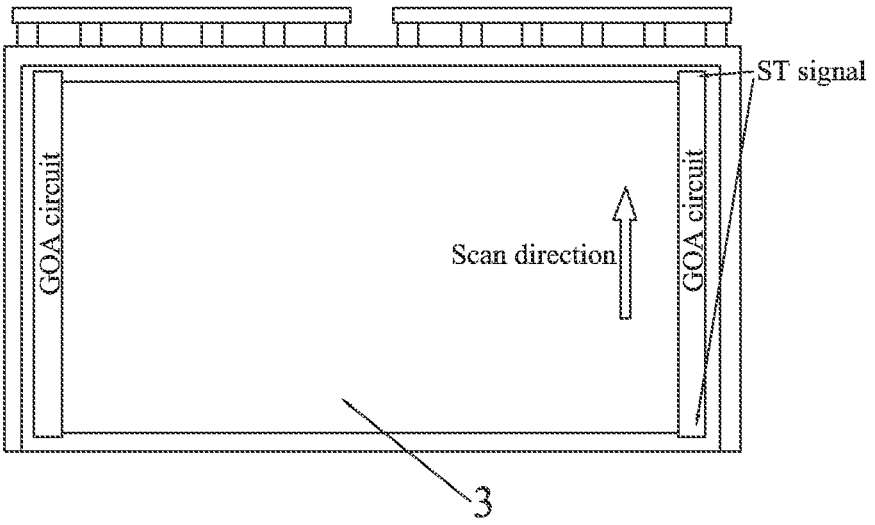
FIG. 2 is a schematic view showing the connection of start signal in the known display panel GOA circuit.
Figure 3:
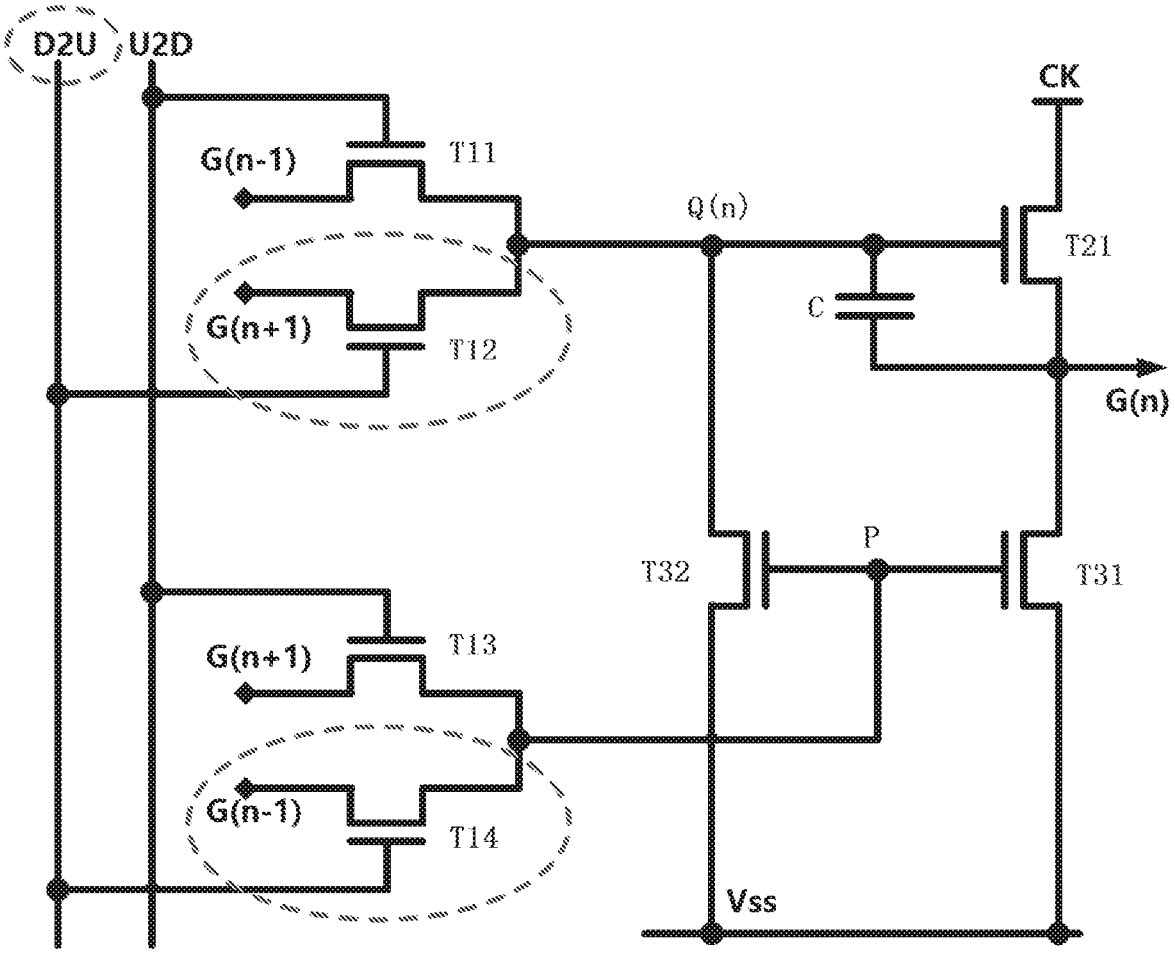
FIG. 3 is a schematic view showing the GOA circuit for display panel of the first embodiment of the present invention.

Referring to FIG. 3, FIG. 3 is a schematic view of the GOA circuit for display panel of the first embodiment of the present invention. The GOA circuit is introduced with D2U and U2D signals and let the D2U and U2D signals control the turn-on order for the GOA circuit and scanning direction for the panel. Correspondingly, in each stage of GOA unit, two additional TFTs are needed, shown as the dash line circle in FIG. 3.

The GOA circuit of the first embodiment comprises: a plurality of cascaded GOA units, for natural numbers n and m, a pull-up control circuit of the n-th GOA unit responsible for outputting an n-th horizontal scan signal G(n) comprising: a first thin film transistor (TFT) T11 having a gate connected to a first scan direction signal U2D, and a source and a drain respectively connected to an (n−m)th stage horizontal scan signal G(n−m) (i.e., before the n-th stage) and a gate signal node Q(n) of the n-th stage GOA unit; a second TFT T12 having a gate connected to a second scan direction signal D2U, and a source and a drain respectively connected to an (n+m)th stage horizontal scan signal G(n+m) (i.e., after the n-th stage) and the gate signal node Q(n) of the n-th stage GOA unit;

a pull-down control circuit of the −nth stage GOA unit comprising: a third TFT T13 having a gate connected to the first scan direction signal U2D, and a source and a drain respectively connected to the (n+m)th stage horizontal scan signal G(n+m) and a node P; a fourth TFT T14 having a gate connected to the second scan direction signal D2U, and a source and a drain respectively connected to the (n−m)th stage horizontal scan signal G(n−m) and the node P; a fifth TFT T31 having a gate connected to the node P, a source and a drain respectively connected to the n-th stage horizontal scan signal G(n) and a low voltage Vss; a sixth TFT T32 having a gate connected to the node P, and a source and a drain respectively connected to the gate signal node Q(n) of the n-th stage GOA unit and the low voltage Vss.

In addition, the n-th stage GOA unit further comprises: a pull-up circuit, a down-propagation circuit, a pull-down maintenance circuit, and a bootstrap capacitor for raising the voltage level. In the present embodiment, the bootstrap capacitor is specifically a capacitor C, and the pull-up circuit is specifically a TFT T21 whose gate is connected to the gate signal node Q(n) of the n-th stage GOA unit, and the source and the drain are respectively connected to the clock signal CK and the horizontal scan signal G(n) of the corresponding GOA unit of the current stage. The details of rest of the GOA unit will not be described here.

Wherein, the value of m is determined according to a number of clock signals CK required by the GOA circuit; for a GOA circuit requiring two clock signals, m is 1, as shown in FIG. 3; for a GOA circuit requiring 4 clock signals, m is 2.

The problem of the prior art can be solved by employing a GOA circuit that can change the scanning order as shown in FIG. 3. However, at least two TFTs and a plurality of driving signals must be added to the GOA circuit, which is disadvantageous in terms of the complexity of the circuit design and the space occupied by the GOA circuit.

When the display panel using the GOA circuit of FIG. 3 is cut into a strip screen, scanning from top to bottom and from bottom to top can be realized by changing the relative voltage levels between the U2D and D2U signals. When the display panel is cut into a strip screen with a width ratio greater than (>) 16:9, U2D can be set to a high voltage, D2U is set to a low voltage, and the scanning direction of the strip screen is fixed to scan from top to bottom.

Figure 4:
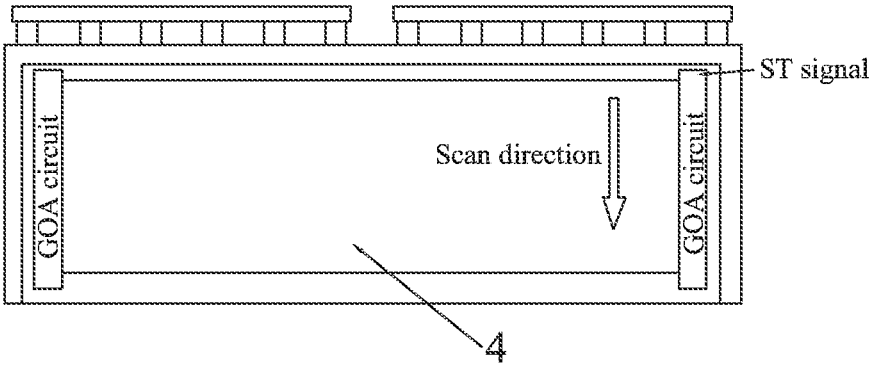
FIG. 4 is a schematic view showing the scanning direction of the GOA circuit for display panel in FIG. 3 after cutting into strip screens.

FIG. 4 is a schematic view of the scanning direction after the display panel of the GOA circuit of FIG. 3 is cut into a strip screen, the strip screen 4 is set to scan from top to bottom, and the start signal ST is inputted from the head end (first stage) of the GOA circuit.

Figure 5:
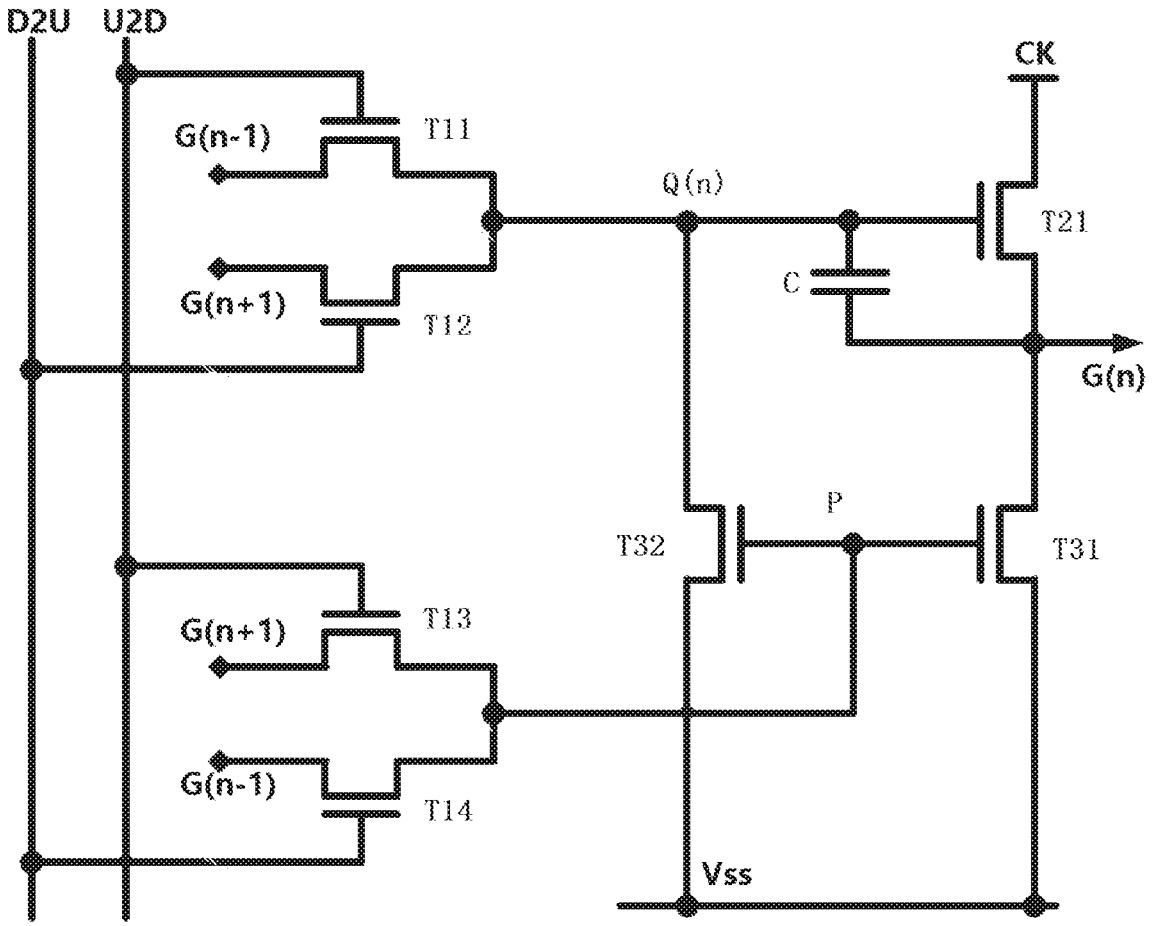
FIG. 5 is a schematic view showing the connection of GOA signal of the strip screen in FIG. 4.

FIG. 5 is a schematic view of a GOA signal connection of the strip screen display panel in FIG. 4. Herein, U2D is set to high voltage, and D2U is set to low voltage, so that each stage of GOA unit in the GOA circuit is guaranteed to be turned on by the above previous stage (i.e., (n−1)th stage) GOA unit, and is pulled down ad turned off by the next stage (i.e., (n+1)th stage) GOA unit below.

The first embodiment of the GOA circuit for display panel of the present invention optimizes the GOA circuit structure design, and adopts a GOA circuit capable of changing the scanning order to realize that the display panel can be cut into strip screens of any aspect ratio.

In the first embodiment of the present invention, it is necessary to introduce two additional TFTs in each stage of the GOA unit, which complicates the circuit design and takes up more space, and is unfavorable to realize narrow border design of the panel. Moreover, sometimes customers also have other specific demands on scanning directions, such as, scanning from bottom to top.

Figure 6:
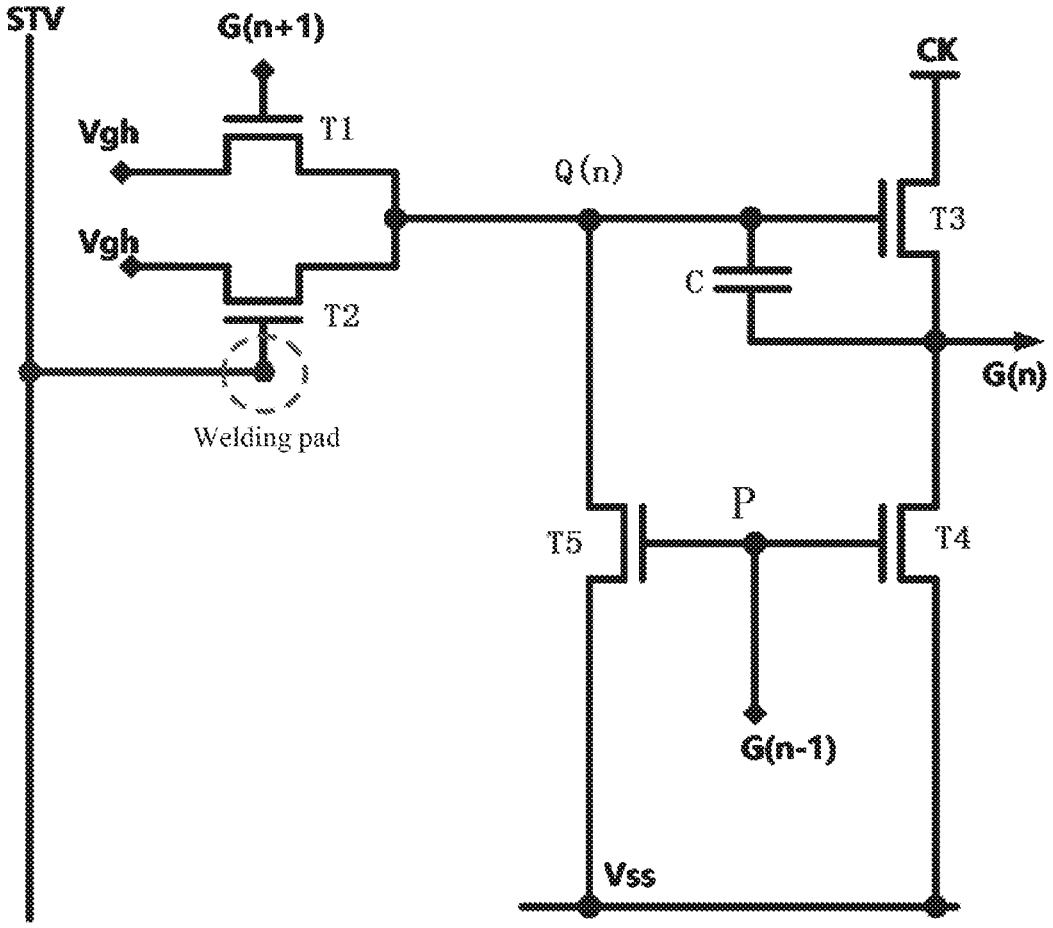
FIG. 6 is a schematic view showing the GOA circuit for display panel of the second embodiment of the present invention.

FIG. 6 is a schematic view of the second embodiment of the GOA circuit for display panel of the present invention, wherein a scanning direction from bottom to top can be realized by only adding an additional TFT.

The second embodiment of the present invention provides a GOA circuit for display panel, which comprises: a plurality of cascaded GOA units, for natural numbers n and m, a pull-up control circuit of the n-th stage GOA unit responsible for outputting an n-th stage horizontal scan signal G(n) comprising: a first thin film transistor (TFT) T1 having a gate connected to an (n+m)th stage horizontal scan signal G(n+m), and a source and a drain respectively connected to a high voltage Vgh and a gate signal node Q(n) of the n-th stage GOA unit; a second TFT T2 having a gate in a floating state and reserved for welding pad for connecting a start signal SW, a source and a drain respectively connected to the high voltage Vgh and the gate signal node Q(n) of the n-th stage GOA unit;

a pull-down control circuit of the n-th stage GOA unit comprising: a third TFT T4 having a gate connected to the (n−m)th th stage horizontal scan signal G(n−m), and a source and a drain respectively connected to the n-th stage horizontal scan signal G(n) and a low voltage Vss; a fourth TFT having a gate connected to the (n−m)th th stage horizontal scan signal G(n−m), and a source and a drain respectively connected to the gate signal node Q(n) of the n-th stage GOA unit and the low voltage Vss.

In addition, the n-th stage GOA unit further comprises: a pull-up circuit, a down-propagation circuit, a pull-down maintenance circuit, and a bootstrap capacitor for raising the voltage level. In the present embodiment, the bootstrap capacitor is specifically a capacitor C, and the pull-up circuit is specifically a TFT T3 whose gate is connected to the gate signal node Q(n) of the n-th stage GOA unit, and the source and the drain are respectively connected to the clock signal CK and the horizontal scan signal G(n) of the corresponding GOA unit of the current stage. The details of rest of the GOA unit will not be described here.

Wherein, the value of m is determined according to a number of clock signals CK required by the GOA circuit; for a GOA circuit requiring two clock signals, m is 1, as shown in FIG. 6; for a GOA circuit requiring 4 clock signals, m is 2.

In FIG. 6, the gate signal node Q(n) of the n-th stage GOA circuit is simultaneously connected to the sources of the two TFTs (T1 and T2), and the drains of the two TFTs are connected to the high voltage Vgh, the gate of one TFT is connected to the output G(n+1) of the next stage GOA unit, the gate of the second TFT is in a floating state. There is a reserved welding pad, the gate and SW signals can be connected by laser welding.

When the display panel designed by the GOA circuit shown in FIG. 6 is cut into a strip screen, it is only necessary to perform a laser welding operation on the last stage GOA unit to realize the bottom-up scanning of the GOA circuit.

Figure 7:
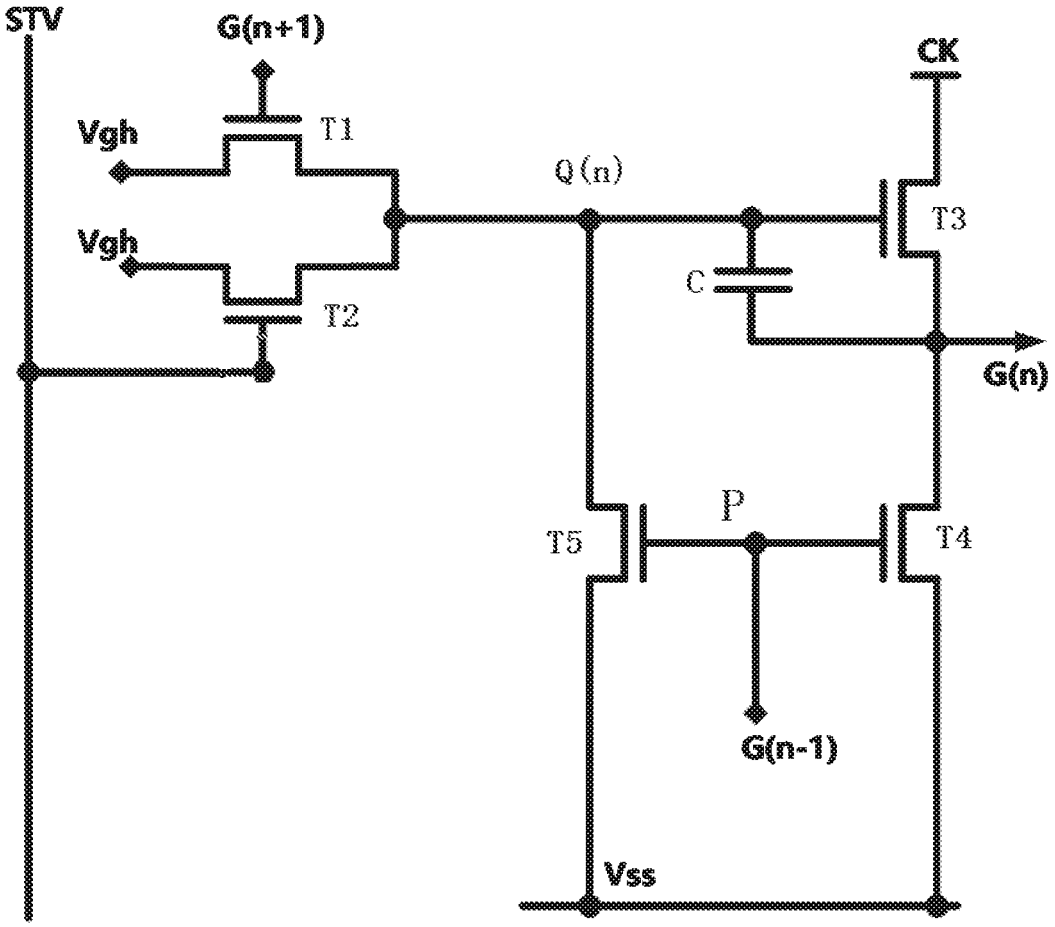
FIG. 7 is a schematic view showing the scanning direction of the GOA circuit for display panel in FIG. 6 after cutting into strip screens.

As shown in FIG. 7, FIG. 7 is a schematic view of a GOA signal connection after the display panel of the GOA circuit in FIG. 6 is cut into a strip screen. Since the lower part of the GOA unit has been cut, the G(n+1) signal will not be propagated to the GOA unit. In this case, a laser welding is required at the reserved welding pad to connect the gate of T2 to the STV signal, and the gate signal node Q(n) of the n-th stage GOA unit is pulled up to a high voltage by the STV to turn on the GOA unit of this stage.

The second embodiment of the GOA circuit for display panel of the present invention optimizes the GOA circuit structure design, and realizes that the display panel can be cut into strip screens of any aspect ratio, and only one TFT is added to realize a narrower border design.

Figure 8:
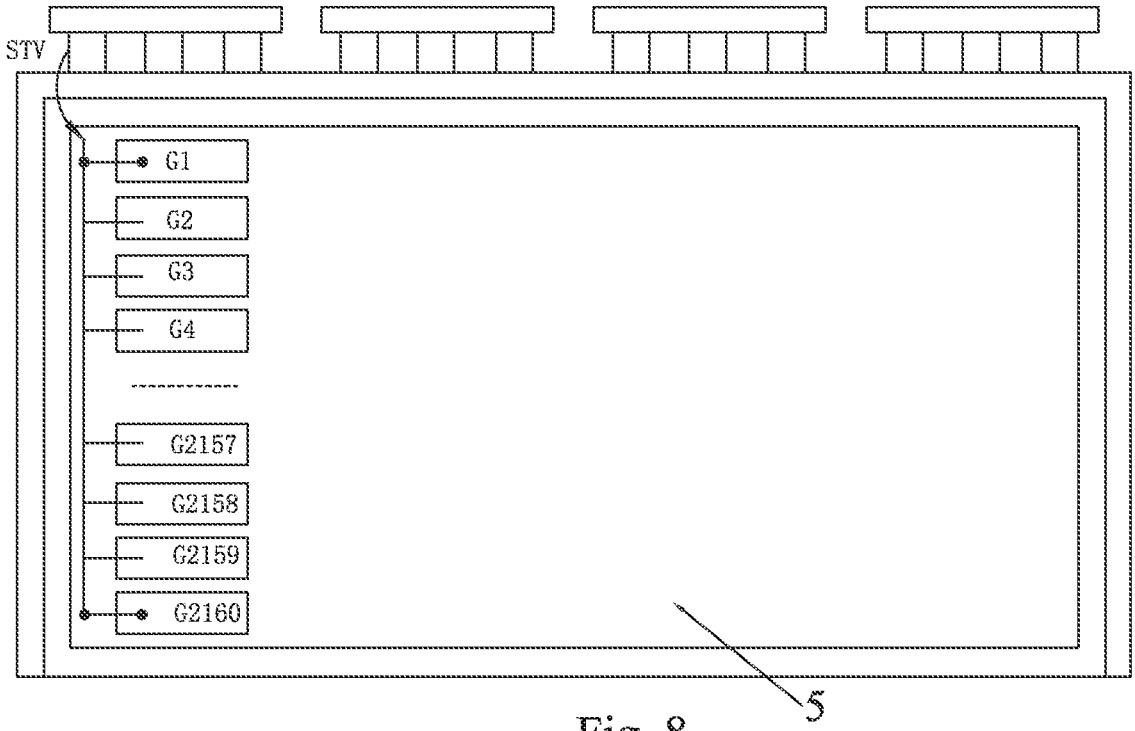
FIG. 8 is a schematic view showing the start signal connection of the display panel in the second embodiment of the present invention, with GOA circuit using two clock signals.

Refer to FIG. 8. FIG. 8 is a schematic view of the start signal connection of display panel according to the second embodiment of the present invention, wherein the GOA circuit has two clock signals. Corresponding to the horizontal scan lines G1-G2160, the GOA circuit for the display panel 5 has a corresponding number of GOA units, and for a GOA circuit having only two clock signals CK, the start signal STV is connected to the first stage and the last stage.

Figure 9:
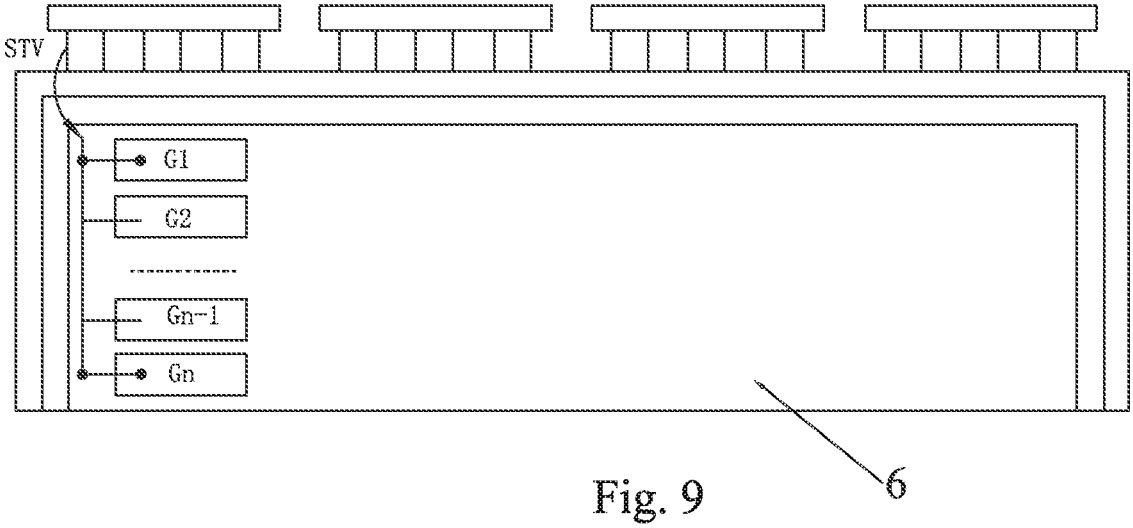
FIG. 9 is a schematic view showing the start signal connection after cutting the display panel in FIG. 8 into a strip screen.

FIG. 9 is a schematic view showing the start signal connection after the display panel of FIG. 8 is cut into a strip screen. When the display panel 5 in FIG. 8 is cut into a strip screen 6, it is necessary to perform a laser welding in the last stage GOA unit of the strip screen 6 to provide the desired start signal STV.

Figure 10:
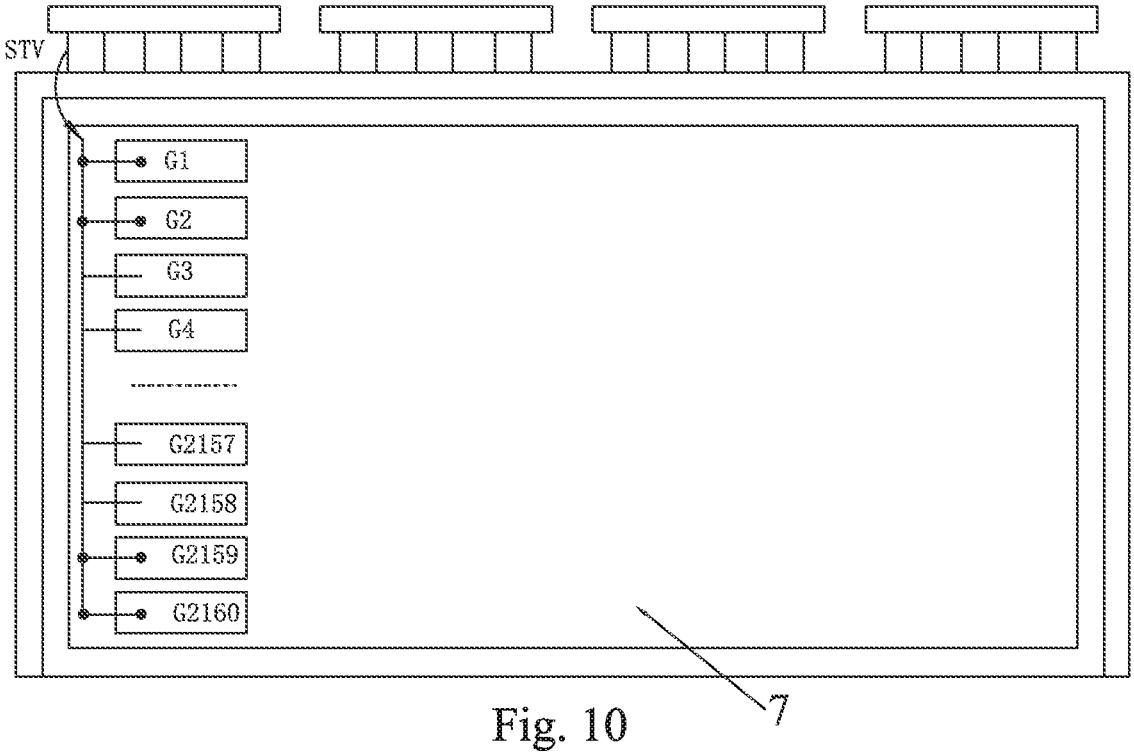
FIG. 10 is a schematic view showing the start signal connection of the display panel in the second embodiment of the present invention, with GOA circuit using four clock signals.

FIG. 10 is a schematic view showing the start signal connection of display panel in accordance with the second embodiment of the present invention, wherein the GOA circuit has four clock signals. Corresponding to the horizontal scan lines G1-G2160, the GOA circuit for the display panel 7 has a corresponding number of GOA units. Similarly, for a GOA circuit having four clock signals CK, the first two levels and the last two levels of the GOA circuit will be connected to the start signal STV.

Figure 11:
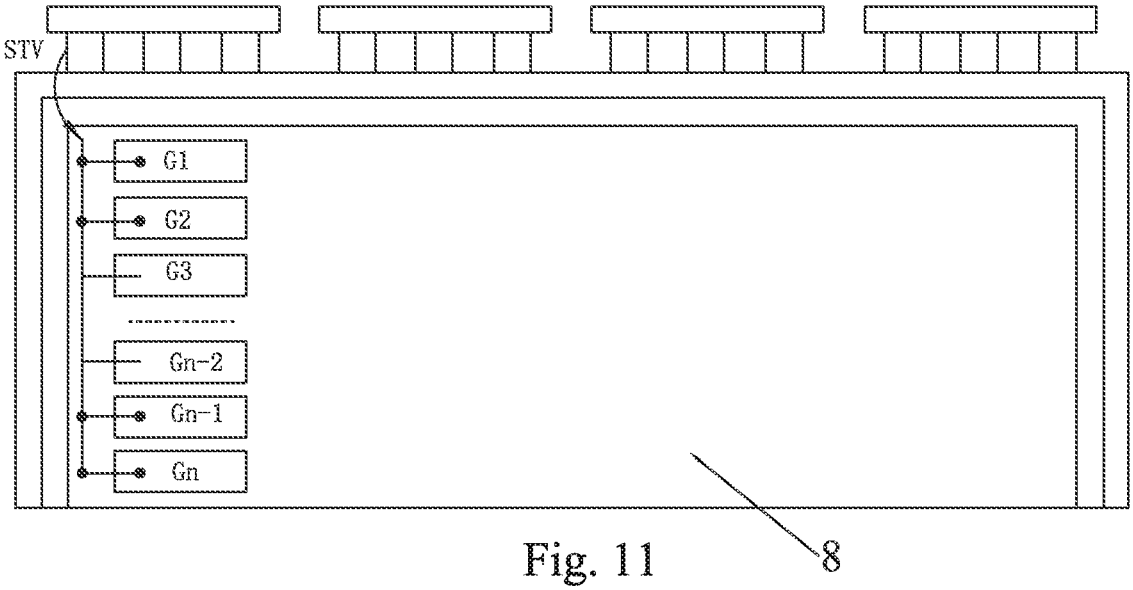
FIG. 11 is a schematic view showing the start signal connection after cutting the display panel in FIG. 10 into a strip screen.

FIG. 11 is a schematic view showing the start signal connection after the display panel of FIG. 10 is cut into a strip screen. When the display panel 7 in FIG. 10 is cut into a strip screen 8, it is necessary to perform laser welding at the last two stages of the strip screen 8 to provide the desired start signal STV.

In summary, the GOA circuit for display panel of the present invention is suitable for the design of the peripheral driving circuit of the display panel, and the design problem of the start signal input encountered when the display panel of the GOA architecture is cut into a strip screen is solved, so that the display panel can be cut into strip screens of any aspect ratio.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A gate driver on array (GOA) circuit for display panel, comprising: a plurality of cascaded GOA units, for natural numbers n and in, a pull-up control circuit of the n-th GOA unit responsible for outputting an n-th horizonal scan signal comprising:

a first thin film transistor (TFT) having a gate connected to a first scan direction signal, and a source and a drain respectively connected to an (n-m)th stage horizontal scan signal and a gate signal node of the n-th stage GOA unit;

a second TFT having a gate connected to a second scan direction signal, and a source and a drain respectively connected to an (n+m)th stage horizontal scan signal and the gate signal node of the n-th stage GOA unit;

a pull-down control circuit of the -nth stage GOA unit comprising:

a third TFT having a gate connected to the first scan direction signal, and a source and a drain respectively connected to the (n+m)th stage horizontal scan signal and a node;

a fourth TFT having a gate connected to the second scan direction signal, and a source and a drain respectively connected to the (n-m)th stage horizontal scan signal and the node;

a fifth TFT having a gate connected to the node, a source and a drain respectively connected to the n-th stage horizontal scan signal and a low voltage;

a sixth TFT having a gate connected to the node, and a source and a drain respectively connected to the gate signal node of the n-th stage GOA unit and the low voltage, wherein the first scan direction signal is connected to the gates of the first and third TFTs of each of the plurality of cascaded GOA units and the second scan direction signal is connected to the gates of the second and fourth TFTs of each of the plurality of cascaded GOA units, such that the gates of the first and second TFTs of the pull-up control circuit are respectively connected to the first and second scan direction signals that are different and the gates of the third and fourth TFTs of the pull-down control circuit are respectively connected to the first and second scan direction signals that are different, the sources of the first and fourth TFTs being connected to the (n-m)th stage horizontal scan signal that is different from the first and second scan direction signals, the sources of the second and third TFTs being connected to the (n+m)th stage horizontal scan signal that is different from the first and second scan direction signals.

2. The GOA circuit for display panel as claimed in claim 1, wherein the scan direction of the GOA circuit for display panel is set by changing relative voltage levels between the first scan direction signal and the second scan direction signal.

3. The GOA circuit for display panel as claimed in claim 2, wherein the first scan direction signal is set to a high voltage, the second scan direction signal is set to a low voltage, and the GOA circuit for display panel realizes scanning from top to bottom; or, the first scan direction signal is set to a low voltage, the second scan direction signal is set to a high voltage, and the GOA circuit for display panel realizes scanning from bottom to top.

4. The GOA circuit for display panel as claimed in claim 1, wherein the value of m is determined according to a number of clock signals required by the GOA circuit.

5. The GOA circuit for display panel as claimed in claim 4, wherein for a GOA circuit requiring two clock signals, m is 1; for a GOA circuit requiring four clock signals, m is 2.

6. A GOA circuit for display panel, comprising: a plurality of cascaded GOA units, for natural numbers n and m, a pull-up control circuit of the n-th stage GOA unit responsible for outputting an n-th stage horizontal scan signal comprising:

a first thin film transistor (TFT) having a gate connected to an (n+m)th stage horizontal scan signal, and a source and a drain respectively connected to a high voltage and a gate signal node of the n-th stage GOA unit;

a second TFT having a gate in a floating state and reserved for welding pad for connecting a start signal, a source and a drain respectively connected to the high voltage and the gate signal node of the n-th stage GOA unit;

a pull-down control circuit of the n-th stage GOA unit comprising:

a third TFT having a gate connected to the (n-m)th stage horizontal scan signal, and a source and a drain respectively connected to the n-th stage horizontal scan signal and a low voltage;

a fourth TFT having a gate connected to the (n-m)th stage horizontal scan signal, and a source and a drain respectively connected to the gate signal node of the n-th stage GOA unit and the low voltage, wherein the start signal is connectable to the gate of the second TFT of each of the plurality of cascaded GOA units, such that the gates of the first and second TFTs of the pull-up circuit are respectively connected to the (n+m)th stage horizontal scan signal and the start signal that are different, and the sources of the first and second TFTs are both connected to the high voltage that supplies a signal different from the (n+m)th stage horizontal scan signal and the start signal.

7. The GOA circuit for display panel as claimed in claim 6, wherein when the display panel is cut into a strip screen, the gate of the second TFT of the last m-th stage GOA unit is connected to the start signal.

8. The GOA circuit for display panel as claimed in claim 7, wherein the gate of the second TFT of the last m-th stage GOA unit is connected to the welding pad by laser welding.

9. The GOA circuit for display panel as claimed in claim 6, wherein the value of m is determined according to a number of clock signals required by the GOA circuit; for a GOA circuit requiring two clock signals, m is 1; for a GOA circuit requiring four clock signals, m is 2.

10. The GOA circuit for display panel as claimed in claim 6, wherein the n-th stage GOA unit further comprises a bootstrap capacitor and a pull-up circuit; the bootstrap capacitor has two ends respectively connected to the gate signal node of the n-th stage GOA unit and an n-th stage horizontal scan signal;

the pull-up circuit comprises a fifth TFT; the fifth has a gate connected to the gate signal node of the n-th stage GOA unit, and a source and a drain respectively connected to the clock signal of the n-th stage GOA unit and the n-th stage horizontal scan signal.

* * * * *